US006387459B1

(12) United States Patent
Weder

(10) Patent No.: US 6,387,459 B1
(45) Date of Patent: May 14, 2002

(54) DECORATIVE RIBBON MATERIALS AND METHODS FOR PRODUCING SAME

(75) Inventor: Donald E. Weder, Highland, IL (US)

(73) Assignee: Southpac Trust International, Inc., Rarotonga (CK)

( * ) Notice: Subject to any disclaimer, the term of this patent is extended or adjusted under 35 U.S.C. 154(b) by 0 days.

(21) Appl. No.: 09/585,080

(22) Filed: Jun. 1, 2000

Related U.S. Application Data

(63) Continuation-in-part of application No. 09/115,965, filed on Jul. 15, 1998, now abandoned, which is a continuation-in-part of application No. 08/717,336, filed on Sep. 20, 1996, now Pat. No. 5,921,061, which is a continuation-in-part of application No. 08/454,474, filed on May 30, 1995, now Pat. No. 5,701,720, which is a continuation of application No. 08/179,057, filed on Jan. 7, 1994, now Pat. No. 5,576,089.

(51) Int. Cl.[7] ..... B44F 1/10

(52) U.S. Cl. ..... 428/29; 428/4; 428/5; 428/30; 428/337; 428/458; 428/542.6

(58) Field of Search ..... 428/162, 457, 428/147, 458, 141, 337, 161, 332, 195, 209, 461, 464, 542.6, 5, 4, 7, 29, 30; 53/397, 461

(56) References Cited

U.S. PATENT DOCUMENTS

| | | | | |
|---|---|---|---|---|
| 2,200,111 | A | 5/1940 | Bensel | 229/87 |
| 2,323,287 | A | 7/1943 | Amberg | 229/1.5 |

(List continued on next page.)

FOREIGN PATENT DOCUMENTS

| | | |
|---|---|---|
| BE | 654427 | 1/1965 |
| CH | 560532 | 4/1975 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| EP | 428234 A | 5/1991 |
| EP | 0791543 | 8/1997 |
| FR | 1376047 | 9/1964 |
| FR | 2137325 | 12/1972 |
| FR | 2603159 | 3/1989 |
| FR | 2619698 | 3/1989 |
| GB | 5605 | 5/1885 |
| GB | 2056410 | 3/1981 |
| IT | 224507 | 4/1996 |
| NL | 8301709 | 12/1984 |
| NL | 1000658 | 1/1996 |
| WO | 9315979 | 8/1993 |

OTHER PUBLICATIONS

"Foil Jackets" brochure, Custom Medallion, Inc., Dec. 1996, 2 pgs.

"Derwent Abstract" of FR 2610604A. It is noted that Abstract is an incorrect English translation of the contents of the French Patent. French patent does not enable or disclose adhesively attaching the covering to the container. 1988 No month.

*Primary Examiner*—Deborah Jones
*Assistant Examiner*—Abraham Bahta
(74) *Attorney, Agent, or Firm*—Dunlap, Codding & Rogers, P.C.

(57) ABSTRACT

A ribbon material produced by cutting a sheet or web of flexible material into strips of flexible material having a uniform, predetermined width such that the ribbon material can be wrapped about items and formed into bows and decorative ornamentations containing ruffles, loops and curved segments. The ribbon material can be a flexible material having a holographic design on at least one surface thereof or a flexible laminated material containing a holographic design or an iridescent material. The ribbon material can also be textured, printed and/or embossed. At least a portion of the ribbon material may be provided with a matte or textured finish simulating the appearance of cloth.

39 Claims, 7 Drawing Sheets

U.S. PATENT DOCUMENTS

| | | | | | |
|---|---|---|---|---|---|
| 2,688,354 | A | | 9/1954 | Berger | 150/28 |
| 3,080,680 | A | | 3/1963 | Reynolds | 47/37 |
| 3,481,663 | A | | 12/1969 | Greenstein | 428/30 |
| 3,510,054 | A | | 5/1970 | Sannie et al. | 229/66 |
| 3,512,700 | A | | 5/1970 | Evans et al. | 229/53 |
| 4,248,347 | A | | 2/1981 | Trimbee | 206/423 |
| D259,333 | S | | 5/1981 | Charbonneau | D9/306 |
| 4,265,049 | A | | 5/1981 | Gorewitz | 47/26 |
| 4,717,262 | A | | 1/1988 | Roen et al. | 383/120 |
| 4,810,109 | A | | 3/1989 | Castel | 383/105 |
| 4,988,563 | A | | 1/1991 | Wehr | 428/207 |
| 5,074,675 | A | | 12/1991 | Osgood | 383/122 |
| 5,310,222 | A | | 5/1994 | Chatwin et al. | 283/86 |
| 5,350,240 | A | | 9/1994 | Billman et al. | 383/104 |
| 5,443,670 | A | | 8/1995 | Landau | 156/191 |
| D368,025 | S | | 3/1996 | Sekerak et al. | D9/305 |
| 5,496,252 | A | | 3/1996 | Gilbert | 493/224 |
| 5,526,932 | A | | 6/1996 | Weder | 206/423 |
| 5,572,851 | A | | 11/1996 | Weder | 53/399 |
| 5,575,133 | A | | 11/1996 | Weder et al. | 53/397 |
| 5,576,089 | A | * | 11/1996 | Weder | 428/142 |
| 5,609,928 | A | * | 3/1997 | Yedin et al. | 428/5 |
| 5,617,703 | A | | 4/1997 | Weder | 53/413 |
| 5,701,720 | A | * | 12/1997 | Weder | 53/397 |
| 5,921,061 | A | * | 7/1999 | Weder | 53/397 |
| 5,922,455 | A | * | 7/1999 | Stepanek | 428/332 |

* cited by examiner

DECORATIVE RIBBON MATERIALS AND METHODS FOR PRODUCING SAME

CROSS-REFERENCE TO RELATED APPLICATIONS

This application is a continuation-in-part of U.S. Ser. No. 09/115,965, filed Jul. 15, 1998, entitled "DECORATIVE RIBBON MATERIALS AND METHODS FOR PRODUCING SAME", now abandoned; which is a continuation-in-part of U.S. Ser. No. 08/717,336, filed Sep. 20, 1996, entitled "OPTICAL EFFECT MATERIAL", now U.S. Pat. No. 5,921,061, issued on Jul. 13, 1999; which is a continuation-in-part of U.S. Ser. No. 08/454,474, filed May 30, 1995, entitled "OPTICAL EFFECT MATERIAL AND METHODS", now U.S. Pat. No. 5,701,720, issued on Dec. 30, 1997; which is a continuation of U.S. Ser. No. 08/179,057, filed Jan. 7, 1994, entitled "OPTICAL EFFECT MATERIAL AND METHODS", now U.S. Pat. No. 5,576,089, issued on Nov. 19, 1996.

STATEMENT REGARDING FEDERALLY SPONSORED RESEARCH OR DEVELOPMENT

Not applicable

BACKGROUND OF THE INVENTION

FIELD OF THE INVENTION

The present invention relates to decorative materials and more particularly, but not by way of limitation, to ribbon materials produced from optical effect materials and methods for producing such ribbon materials.

DESCRIPTION OF THE PREFERRED EMBODIMENTS

Embodiments of FIGS. 1–4

The present invention describes decorative ribbon materials produced from optical effect materials and methods for producing such decorative ribbon materials. The term "optical effect material" as used herein is to be understood to mean any material capable of changing appearance, such as perspective and/or color, as the angle of view of such material changes. Optical effect materials include, but are not limited to, iridescent materials, materials having holographic designs, iridescent materials having holographic designs, and holographic materials or iridescent materials having embossed patterns and/or printed patterns and the like.

The term "synthetic polymeric film" as used herein means a man-made thermoplastic resinous material such as, but not by way of limitation, polypropylene. A synthetic polymeric film, as contem-plated and described in detail herein, is relatively strong and is not as subject to tearing (substantially non-tearable), as might be the case with paper or foil.

The present invention contemplates providing ribbon materials having an optical effect produced by holograms and/or iridescent materials. The ribbon material can be produced by providing a material having holographic designs or by laminating a light transmitting material (i.e. a clear plastic sheet of material, or a tinted material) to an iridescent material. The light transmitting material permits the iridescent qualities of the iridescent material to be transmitted and seen through the light transmitting material.

Additional characteristics of the material containing the holographic design, the iridescent material, the light transmitting material, and other relevant materials are described herein, and present a variety of interesting, unusual, and decorative effects to ribbons produced from such materials. That is, the ribbon and bows produced from the optical effect materials possess the same optical effect characteristics of the optical effect materials from which the ribbon material is produced while creating additional interesting and aesthetic effects. In addition, the decor of the ribbon and bows can be further enhanced by embossing and/or printing the optical effect materials.

Figure 1:
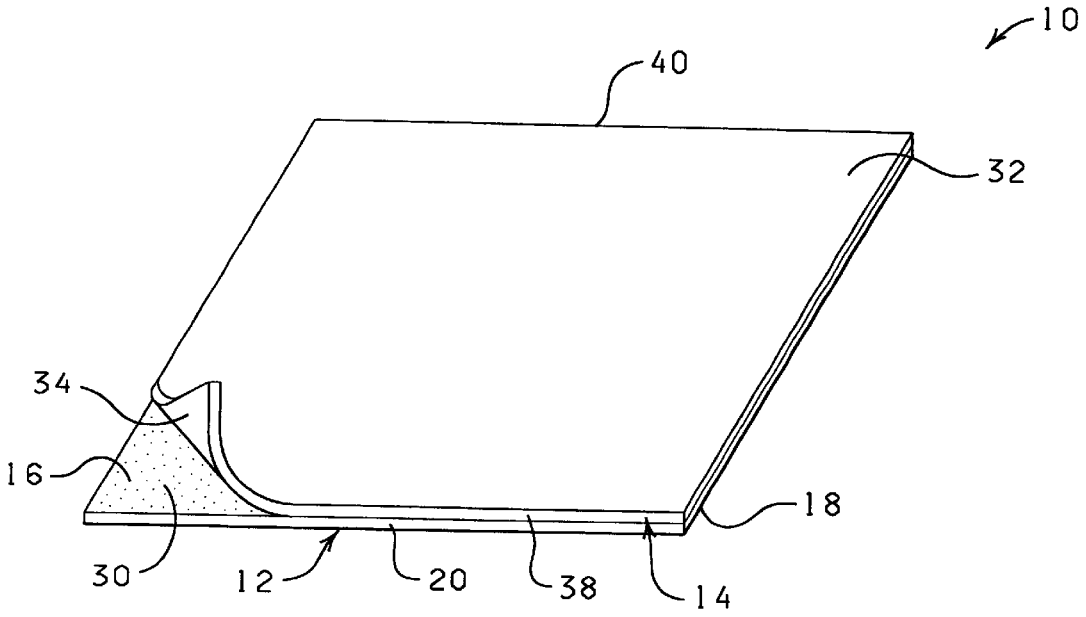
FIG. 1 is a perspective view of a portion of a web or sheet of laminated optical effect material employed in the production of a ribbon material in accordance with the present invention.
Figure 2:
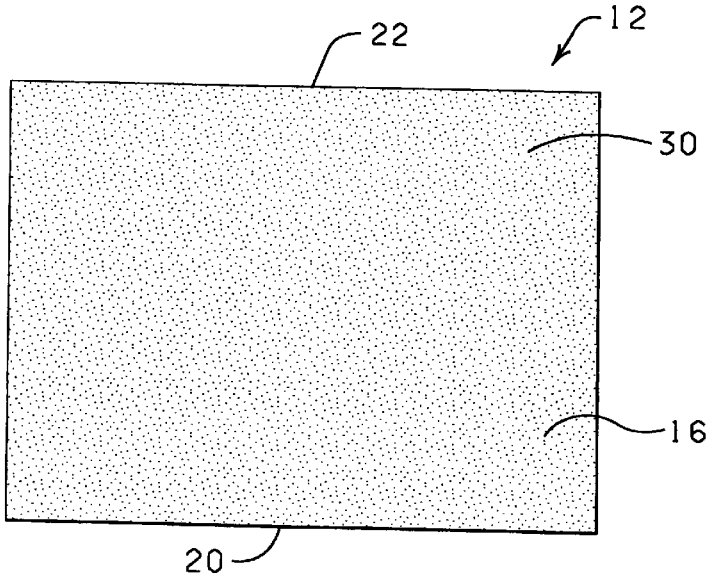
FIG. 2 is a top plan view of a first material of the laminated optical effect material of FIG. 1 illustrating a bonding material on the upper surface of the first material.

Shown in FIG. 1 and designated therein by the general reference numeral 10 is a web or sheet of laminated optical effect material comprising a first web or sheet of material 12 and a second web or sheet of material 14. The first sheet of material 12 has an upper surface 16, a lower surface 18, a first side 20 and a second side 22 (FIG. 2). A bonding material 30 may be disposed on the upper surface 16 of the first sheet of material 12 such that the bonding material 30 substantially covers the upper surface 16 of the first sheet of material 12 as shown in FIG. 2; or the bonding material 30 may also be disposed upon the upper surface 16 of the first sheet of material 12 in the form of one or more strips which extend between the first and second sides 20 and 22 of the first sheet of material 12. It should be understood that the bonding material 30 may also be disposed upon the upper surface 16 of the first sheet of material 12 in the form of spaced apart spots; or the bonding material 30 may also be disposed on the upper surface 16 of the first sheet of material 12 in any other geometric or non-geometric or asymmetric forms, and in any pattern, including fanciful patterns.

The first sheet of material 12 is a flexible material having a thickness in the range of from about 0.1 mil to about 30 mil. Examples of materials which can be used as the first sheet of material 12 in the construction of the optical effect material 10 employed to produce ribbon materials which can be formed into bows and other decorative ornamentation are paper, naturally occurring polymers such as cellophane, synthetic polymers, metallized films, foils, cloth, such as burlap, and combinations thereof. However, when one desires to fabricate the optical effect material 10 wherein the first sheet of material 12 is constructed of a substantially transparent polymeric film material (i.e. a polymeric film material produced from naturally occurring or synthetic polymers which is capable of transmitting light into the second sheet of material 14), the first sheet of material 12 is preferably provided with a thickness in the range of from about 0.1 mil to about 10 mil, and more preferably with a thickness in the range of from about 0.4 mil to about 0.9 mil. Thus, when the first sheet of material 12 is formed of a substantially transparent polymeric film material and the second sheet of material 14 is formed of an iridescent material, the iridescent effect of the second sheet of material 14 can be substantially maintained when viewed through the first sheet of material 12; whereas, when the first sheet of material 12 is formed of a non-transparent material such as a paper, foil, a metallized film (tinted or non-tinted) or cloth, then a portion of the iridescent quality of the second sheet of material 14 is obscured by the first sheet of material 12 (i.e. the portion of the second sheet of material 14 disposed adjacent the first sheet of material 12).

Flexible light transmitting polymeric materials which can be employed as the first sheet of material 12 are commercially available. An example of a commercially available material which can be used as the first sheet of material 12 is Vifan BT medium slip biaxially oriented polypropylene film (clear), having a thickness in a range from between about 0.4 mil and about 0.9 mil, and which is available from Vifan Canada, Inc., Vifan street, Lanoraie d'Autray, Quebec, Canada JOK 1EO. Another example of a commercially available material which can be used as the first sheet of material 12 is HERCULES® B523 oriented polypropylene packaging film (clear), having a thickness in a range of between about 0.4 mil and about 0.9 mil, and which is available from Hercules Incorporated, Hercules Plaza, Wilmington, Del. 19894.

While the first sheet of material 12 has been shown as being a single layer of material, it should be understood that the first sheet of material 12 may be constructed of a plurality of layers of the same or different types of materials which are laminated or bonded together, provided the flexibility of the optical effect material 10 is maintained and, when desired, the light transmitting properties of the first sheet of material 12 are maintained.

The second sheet of material 14 is a substantially flexible iridescent film having an upper surface 32, a lower surface 34, a first side 38 and a second side 40 (FIG. 1). The second sheet of material 14 has a thickness in a range of from about 0.1 mil to about 10 mil, and more preferably from about 0.4 mil to about 0.9 mil. Flexible iridescent films which can be employed as the second sheet of material 14 are commercially available, and the prior art is replete with various methods for making iridescent materials. An example of a commercially available flexible iridescent film which can be used as the second sheet of material 14 is IF-8531 R/S, having a thickness in a range of from about 0.4 mil to about 0.9 mil, and which is manufactured by Mearl Corporation, 1050 Lower South Street, Peekskill, N.Y., 10566.

Additional iridescent materials and the methods of making such materials are disclosed in U.S. Pat. No. 3,231,645, entitled "Method of Making Iridescent Plastic Sheets," issued to Bolomey on Jan. 25, 1966; U.S. Pat. No. 3,481,663, entitled, "Iridescent Articles and Methods of Manufacture", issued to Greenstein on Dec. 12, 1969; U.S. Pat. No. 4,162,343, entitled "Multilayer Light-Reflecting Film", issued to Wilcox et al. on Jul. 24, 1979; U.S. Pat. No. RE31,780, entitled "Multilayer Light-Reflecting Film", issued to Cooper et al. on Dec. 25, 1984; U.S. Pat. No. 5,008,143, entitled, "Decorative Objects With Multi-Color Effects", issued to Armanini on Apr. 16, 1991; U.S. Pat. No. 5,089,318, entitled, "Iridescent Film With Thermoplastic Elastomeric Components", issued to Shetty et al. on Feb. 18, 1992, and U.S. Pat. No. 5,154,765, entitled, "Decorative Objects With Multicolor Effects", issued to Armanini on Oct. 13, 1992, all of which are hereby incorporated by reference herein.

The second sheet of material 14 may be constructed of a single layer of material or a plurality of layers of the same or different types of materials, as long as the end result is a material having substantial iridescence which is evident on at least one of the upper surface 32 or the lower surface 34 of the second sheet of material 14, and more preferably on both the upper surface 32 and the lower surface 34 of the second sheet of material 14. When the second sheet of material 14 comprises more than one layer, the layers of material comprising the second sheet of material 14 may be connected together in any manner known in the art.

The bonding material 30 used to laminate the first sheet of material 12 and the second sheet of material 14, as well as to laminate a plurality of the first sheets of material 12 and/or a plurality of the second sheets of material 14, to produce the sheet of optical effect material 10 may be tinted or colored with a dye, pigment, or ink. In this manner, different coloring effects are provided, and the first sheet of material 12 and/or the second sheet of material 14 may be given a colored appearance by use of a colored bonding material as the bonding material 30. U.S. Pat. No. 5,147,706 describes water based ink compositions which may be used to tint the bonding material 30. Alternatively, or in addition to the tinting or coloring of the bonding material 30, the first and/or second sheets of material 12 and 14 may also be tinted. It should be understood that while the bonding material 30 has been shown disposed on the upper surface 16 of the first sheet of material 12, the bonding material 30 may be disposed on the lower surface 34 of the second sheet of material 14.

The term "bonding material" when used herein means an adhesive, possibly a pressure sensitive adhesive, or a cohesive. Where the bonding material is a cohesive, a similar cohesive material must be placed on the adjacent surface of an adjacently disposed sheet of material, such as the lower surface 34 of the second sheet of material 14, for bondingly contacting and bondingly engaging with the cohesive material. The term "bonding material" also includes materials which are heat sealable and, in this instance, the adjacent portions of the material must be brought into contact and then heat must be applied to effect the seal. The term "bonding material" when used herein also means a lacquer, which may be applied to the sheet of material and, in this instance, heat, sound waves, or vibrations, also must be applied to effect the sealing of the lacquer.

The lower surface 18 of the first sheet of material 12 can also be printed, textured or otherwise modified to provide the first sheet of material 12 with a textured or matte finish simulating the appearance of cloth. The term "cloth-like appearance" may be used interchangeably with the term "finish simulating the appearance of cloth." Thus, when the optical effect material 10 is cut into ribbon material and bows or other decorative ornamentation are formed from the ribbon material, the bows or decorative ornamentation are provided with an iridescent finish simulating the appearance of cloth.

In operation, the second sheet of material 14 is placed adjacent the first sheet of material 12 as shown in FIG. 1. In this position, the lower surface 34 of the second sheet of material 14 is disposed adjacent the upper surface 16 of the first sheet of material 12. The bonding material 30 is disposed on the upper surface 16 of the first sheet of material 12, or, alternatively, the bonding material 30 may be disposed on the lower surface 34 of the second sheet of material 14 or the bonding material 30 may be disposed on both the upper surface 16 of the first sheet of material 12 and the lower surface 34 of the second sheet of material 14.

The dimensions of the first sheet of material 12 and the second sheet of material 14 are shown as being substantially equal so that when the first and the second sheets of material 12 and 14 are disposed adjacent each other, the first sheet of material 12 is substantially aligned with the second sheet of material 14. Thus, when at least the first sheet of material 12 and the second sheet of material 14 are laminated together via the bonding material 30 described herein or any other bonding material known in the art, the optical effect material 10 illustrated in FIG. 1 is formed. However, it should be understood that in each embodiment of the optical effect material described herein, it is not required that the laminated sheets of material, such as the first and second sheets of material 12 and 14 of the optical effect material 10, have the same dimensions. Finally, it will be appreciated that all sheets of material shown in all embodiments herein are substantially flat and have a length sufficient to permit the optical effect material 10 to be cut into ribbon material as will be described in more detail herein after.

Figure 3:
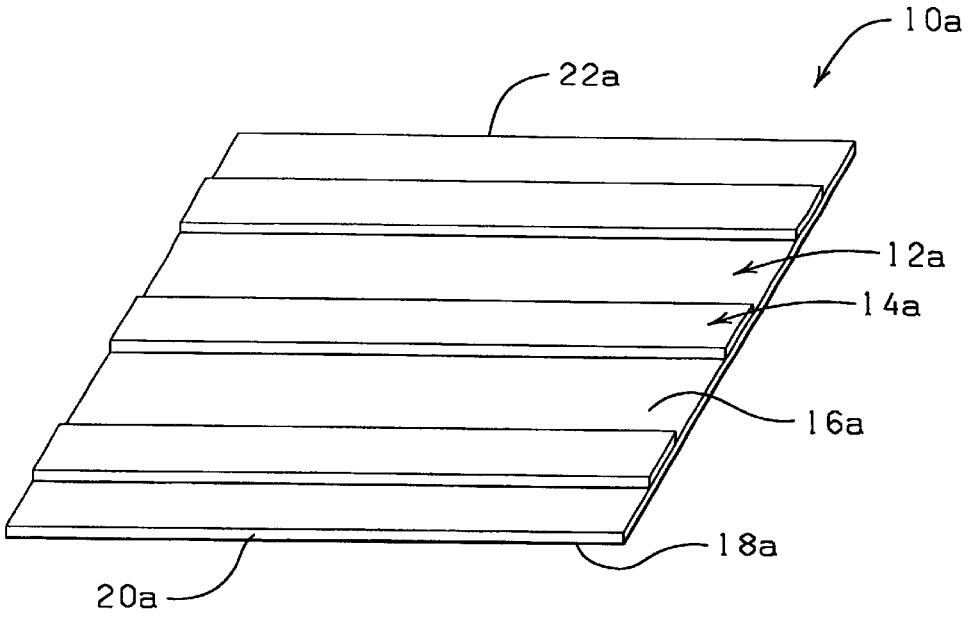
FIG. 3 is a perspective view of another embodiment of a web or sheet of a laminated optical effect material having a first material and a plurality of spatially disposed strips of a second material laminated to an upper surface of the first material.

Shown in FIG. 3 is another embodiment of a laminated optical effect material 10*a* which comprises a first web or sheet of material 12*a* and a plurality of strips of a second sheet of material (only one of which is designated by the numeral 14*a*). The first sheet of material 12*a* has an upper surface 16*a*, a lower surface 18*a*, a first side 20*a* and a second side 22*a*.

The strips of the second sheet of material 14*a* are spatially disposed on the upper surface 16*a* of the first sheet of material 12*a* and extend between the first side 20*a* and the second side 22*a* of the first sheet of material 12*a* substantially as shown. The strips of the second sheet of material 14*a* are laminated or bonded to the first sheet of material 12*a* by any method known in the art.

The first sheet of material 12*a* is a flexible material having a thickness in the range of from about 0.1 mil to about 30 mil. Examples of materials which can be used as the first sheet of material 12*a* in the construction of the optical effect material 10*a* which is employed to produce ribbon materials which can be formed into bows and other decorative ornamentation are paper, naturally occurring polymers such as cellophane, synthetic polymers, metallized films, foils, cloth such as burlap, laminates thereof and combinations thereof. However, when one desires to fabricate the sheet of laminated optical effect material 10*a* wherein the first sheet of material 12*a* is constructed of a substantially transparent polymeric film material (i.e. a polymeric film material produced from naturally occurring and synthetic polymers which is capable of transmitting light into the strips of the second sheet of material 14*a*), the first sheet of material 12*a* is preferably provided with a thickness in the range of from about 0.1 mil to about 10 mil, and more preferably with a thickness in the range of from about 0.4 mil to about 0.9 mil. Thus, when the first sheet of material 12*a* is formed of a substantially transparent polymeric film material and the strips of the second sheet of material 14*a* are formed of an iridescent material, the iridescent effect of the strips of the second sheet of material 14*a* can be substantially maintained when viewed through the first sheet of material 12*a*.

Flexible light transmitting polymeric materials which can be employed as the first sheet of material 12*a* are commercially available. An example of a commercially available material which can be used as the first sheet of material 12*a* is Vifan BT medium slip biaxially oriented polypropylene film (clear), having a thickness in a range from between about 0.4 mil and about 0.9 mil, and which is available from Vifan Canada, Inc., Vifan street, Lanoraie d'Autray, Quebec, Canada JOK 1EO. Another example of a commercially available material which can be used as the first sheet of material 12*a* is HERCULES® B523 oriented polypropylene packaging film (clear), having a thickness in a range of between about 0.4 mil and about 0.9 mil, and which is available from Hercules Incorporated, Hercules Plaza, Wilmington, Del. 19894.

While the first sheet of material 12*a* has been shown as being a single layer of material, it should be understood that the first sheet of material 12*a* may be constructed of a plurality of layers of the same or different types of materials which are laminated or bonded together, provided the flexibility of the optical effect material 10*a* is maintained and when desired, the light transmitting properties of the first sheet of material 12*a* are maintained.

The strips of the second sheets of material 14*a* are strips of a substantially flexible iridescent film having a thickness in a range of from about 0.1 mil to about 10 mil, and more preferably from about 0.1 mil to about 0.9 mil. As previously stated, flexible iridescent films which can be employed as the strips of the second sheet of material 14*a* are commercially available. An example of a commercially available flexible iridescent film which can be used as the strips of the second sheet of material 14*a* is IF-8531 R/S, having a thickness in a range of from about 0.4 mil to about 0.9 mil, and which is manufactured by Mearl Corporation, 1050 Lower South Street, Peekskill, N.Y., 10566.

The strips of the second sheet of material 14*a* may be constructed of a single layer of material or a plurality of layers of the same or different types of materials, as long as the end result is that the strips of the second sheet of material 14*a* are substantially iridescent. When the strips of the second sheet of material 14*a* comprise more than one layer, the layers of material comprising the strips of the second sheet of material 14*a* may be connected together in any manner known in the art. Further, if a bonding material is used to laminate the strips of material to produce the strips of the second sheet of material 14*a* or to laminate the strips of the second sheet of material 14*a* to the first sheet of material 12*a* to produce the sheet of laminated optical effect material 10*a*, the bonding material may be tinted or colored with a dye, pigment, or ink. Alternatively, or in addition to the tinting or coloring of the bonding material, the first sheet of material 12*a* and/or strips of the second sheet of material 14*a* may also be tinted.

The use of a light transmitting material, such as a plastic film, for example, as the first sheet of material 12*a* permits the iridescence of the strips of the second sheet of material 14*a* to be substantially maintained through the first sheet of material 12*a*. However, when the strips of the second sheet of material 14*a* are laminated to the first sheet of material 12*a*, and the first sheet of material 12*a* is either paper, foil, metallized film (tinted or non-tinted) or cloth, then a portion of the iridescent quality of the strips of the second sheet of material 14*a* are obscured by the first sheet of material 12*a* (i.e. the portion of the strips of the second sheet of material 14*a* adjacent the first sheet of material 12*a*).

The lower surface 18*a* of the first sheet of material 12*a* can also be printed, textured or otherwise modified to provide the first sheet of material 12*a* with a textured or matte finish simulating the appearance of cloth. Thus, when the sheet of laminated optical effect material 10*a* is cut into ribbon material and bows, or other decorative ornamentation is formed from the ribbon material, the bows or decorative ornamentation are provided with an iridescent finish simulating the appearance of cloth.

Figure 4:
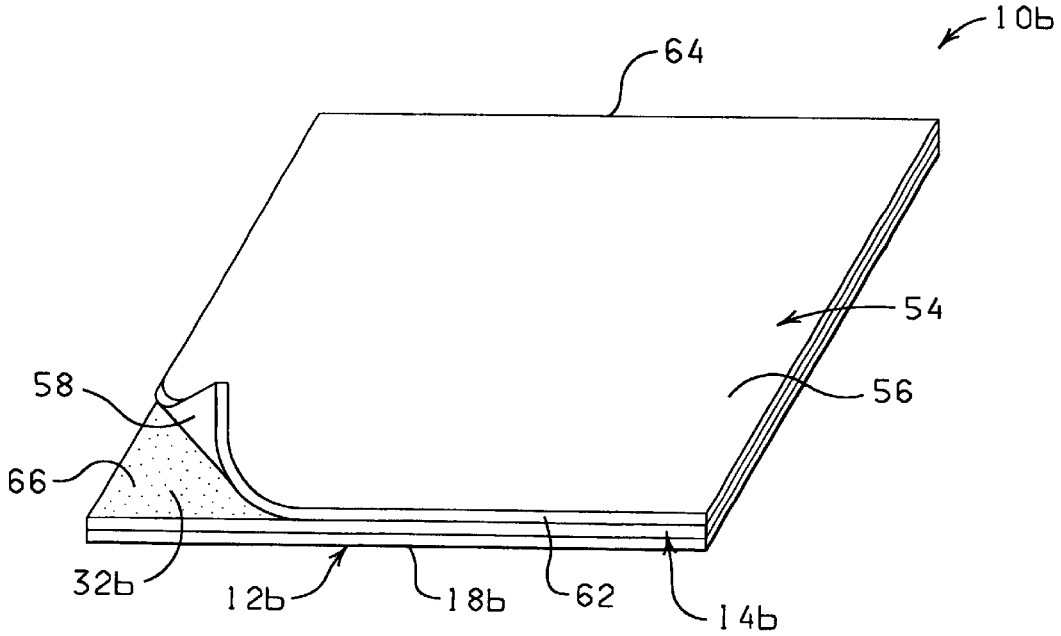
FIG. 4 is a perspective view of another embodiment of a laminated optical effect material wherein a third material is disposed adjacent and bonded to an upper surface of a second material, which is also disposed adjacent a first material.

Shown in FIG. 4 is another embodiment of a sheet of laminated optical effect material 10*b* of the present invention. The sheet of laminated optical effect material 10*b* comprises a first web or sheet of material 12*b*, a second web or sheet of material 14*b* and a third web or sheet of material 54. At least one of the first and third sheets of material 12*b* and 54, respectively, is formed of a substantially transparent polymeric film material (i.e. a polymeric film material produced from naturally occurring or synthetic polymers which is capable of transmitting light into the second sheet of material 14*b*); and the second sheet of material 14*b* is formed of a substantially flexible iridescent film. When the first sheet of material 12*b* is formed of a substantially transparent polymeric film material, the third sheet of material 54 may be formed of paper, naturally occurring polymers such as cellophane, synthetic polymers including substantially transparent polymeric film material, metallized films, foils, cloth such as burlap, laminates thereof and combinations thereof. Further, at least one of the first and third sheets of material 12*b* and 54 can be printed, embossed or textured to provide at least one side of the optical effect material 10*b* with a cloth like appearance.

The thickness of the first sheet of material 12*b*, the second sheet of material 14*b* and the third sheet of material 54 can vary widely, the only requirement being that the optical effect material 10*b* formed from the first, second and third sheets of material 12*b*, 14*b* and 54 be sufficiently flexible so that when the sheet of laminated optical effect material 10*b* is cut into ribbon material, bows and other decorative ornamentations can be formed from the ribbon material. Examples of materials which can be used as the first sheet of material 12*b* in the construction of the sheet of laminated optical effect material 10*b* so that the sheet of laminated optical effect material 10*b* can be employed to produce ribbon materials which can be formed into bows and other decorative ornamentation are paper, naturally occurring polymers such as cellophane, synthetic polymers, metallized films, foils, cloth such as burlap, laminates thereof and combinations thereof.

When one desires to fabricate the sheet of laminated optical effect material 10 wherein the first sheet of material 12*b* is constructed of a substantially transparent polymeric film material (i.e. a polymeric film material produced from naturally occurring or synthetic polymers which is capable of transmitting light into the second sheet of material 14*b*), the iridescent effect of the second sheet of material 14*b* can be substantially maintained when viewed through the first sheet of material 12*b*; whereas, when the first sheet of material 12*b* is formed of a non-transparent material such as paper, foil, metallized film (tinted or non-tinted) or cloth, then a portion of the iridescent quality of the second sheet of material 14*b* is obscured by the first sheet of material 12*b* (i.e. the portion of the second material 14*b* disposed adjacent the first sheet of material 12*b*).

In the embodiment shown in FIG. 4, the first sheet of material 12*b* is formed of a substantially transparent film having a thickness in a range of from about 0.1 mil to about 10 mil, and more preferably from about 0.4 mil to about 0.9 mil; the second sheet of material 14*b* is formed of a substantially flexible iridescent film having a thickness in a range of from about 0.1 mil to about 10 mil, and more preferably from about 0.4 mil to about 0.9 mil; and the third sheet of material 54 is formed of a material having a thickness in a range of from about 0.1 mil to about 10 mil, and more preferably from about 0.4 mil to about 0.9 mil. The third sheet of material 54 may possess substantially similar characteristics and qualities as the first sheet of material 12*b*, or the third sheet of material 54 may have different character-istics and qualities than the first sheet of material 12*b*, provided the third sheet of material 54 is flexible and suitable for making a ribbon material which can be formed into bows and other decorative ornamentations.

The third sheet of material 54 is characterized as having an upper surface 56, a lower surface 58, a first side 62 and a second side 64. The third sheet of material 54 may be of the same configuration and width as the first and second sheets of material 12*b* and 14*b*, respectively; or the third sheet of material 54 may have a different configuration and/or width than the first and/or second sheets of material 12*b* and 14*b*, respectively.

In forming the sheet of laminated optical effect material 10*b*, the third sheet of material 54 is laminated to the upper surface 32*b* of the second sheet of material 14*b* via a bonding material 66 substantially as shown in FIG. 4.

However, it should be understood that the third sheet of material 54 may be laminated to the remaining non-laminated surface of the first sheet of material 12*b*, i.e. the lower surface 18*b* of the first sheet of material 12*b*. The third sheet of material 54 may comprise more than one layer of material. When the third sheet of material 54 comprises more than one layer, the layers of material comprising the third sheet of material 54 may be connected together in any manner known in the art. Further, if a bonding material is used to laminate the sheets of material to produce the third sheet of material 54 or if the bonding material 66 is used to laminate the third sheet of material 54 to the second sheet of material 14*b* (FIG. 4), and if a bonding material (not shown) is used to laminate the first sheet of material 12*b* to the second sheet of material 14*b* to produce the sheet of laminated optical effect material 10*b*, the bonding material may be tinted or colored with a dye, pigment, or ink. In this manner, different coloring effects are provided, and the first sheet of material 12*b* and/or the second sheet of material 14*b*, and/or the third sheet of material 54 may be given a colored appearance by use of a colored bonding material as hereinbefore described. Alternatively, or in addition to the tinting or coloring of the bonding material, the first sheet of material 12*b* and/or the third sheet of material 54 may also be tinted. Moreover, when multiple sheets of material are used to form the third sheet of material 54, the sheets of material need not be uniform in size or shape. That is, one sheet of material may extend beyond at least a portion of the outer periphery of another sheet of material.

The use of a light transmitting material, such as a plastic film, for example, as the first and third sheets of material 12*b* and 54 permits the iridescence of the second sheet of material 14*b* to be substantially maintained through the first sheet of material 12*b* and the third sheet of material 54. Further, the first, second, and/or third sheets of material 12*b*, 14*b*, and 54 of the optical effect material 10*b* may consist of a textured surface and/or designs or decorative patterns which are printed, etched, and/or embossed thereon using inks or other printing materials, as well as embossing techniques. An example of an ink which may be applied to the surface of the first, second and/or third sheets of material 12*b*, 14*b* and 54 of the optical effect material 10*b* is described in U.S. Pat. No. 5,147,706 entitled "Water Based Ink On Foil And/Or Synthetic Organic Polymer" issued to Kingman on Sep. 15, 1992 and which is hereby incorporated herein by reference. In addition, the first, second and/or third sheets of material 12*b*, 14*b* and 54 may have various colorings, coatings, flocking and/or metallic finishes, or other decorative surface ornamentation applied separately or simultaneously or may be characterized totally or partially by pearlescent, translucent, transparent, iridescent or the like qualities. Each of the above-named characteristics may occur alone or in combination and may be applied to the upper and/or lower surfaces of the first, second and/or third sheets of material 12*b*, 14*b* and 54. Moreover, each surface of the first, second, and/or third sheets of material 12*b*, 14*b* and 54 may vary in the combination of such characteristics.

Figure 5:
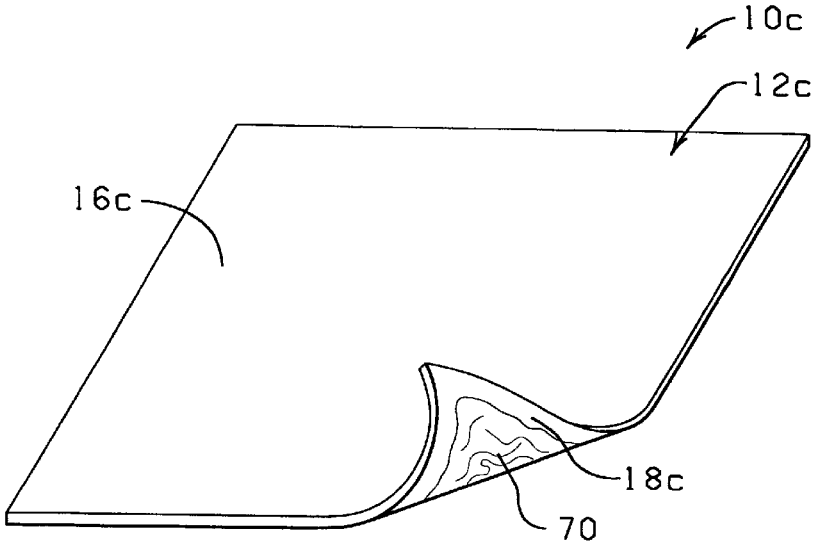
FIG. 5 is a perspective view of a web or sheet of optical effect material having a holographic design provided thereon.
Figure 6:
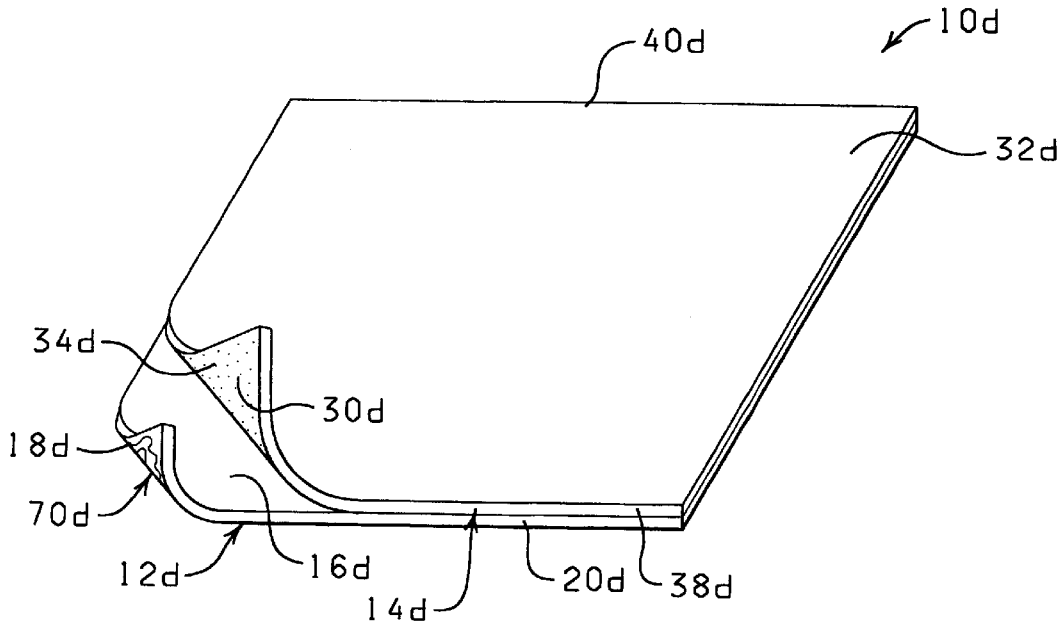
FIG. 6 is a perspective view of a web or sheet of a laminated optical effect material wherein a second web or sheet of material is laminated to one surface of the web or sheet of material having a holographic design of FIG. 5.

Embodiments of FIGS. 5 and 6

Shown in FIG. 5 is yet another embodiment of a sheet of optical effect material 10*c* which is not laminated and which comprises a web or sheet of material 12*c* having a holographic design 70 provided thereon. The sheet of material 12*c* upper surface 16*c* and a lower surface 18*c*. The holographic design 70 is illustrated as being provided on the lower surface 18*c* of the sheet of material 12*c*. However, it should be understood that the holographic design 70 can be provided on the upper surface 16*c*, or both the upper and lower surfaces 16*c* and 18*c*, respectively, of the sheet of material 12*c*; or the holographic design 70 can be provided on only a portion of the upper and/or lower surfaces 16*c* and 18*c*, respectively, of the sheet of material 12*c* or over the entire upper and/or lower surfaces 16*c* and 18*c* of the sheet of material 12*c*, depending on the intended use of the optical effect material 10*c*.

The sheet of material 12*c* has a thickness in a range of from about 0.1 mil to about 30 mil, preferably from about 0.1 mil to about 10 mil. The thickness of the sheet of material 12*c* should be selected so that the sheet of material 12*c* possesses flexibility to permit bows and other ornamental items to be formed from ribbon materials made from the sheet of material 12*c*. The sheet of material 12*c* may be constructed of a number of materials having the required flexibility, such as paper, naturally occurring polymers such as cellophane, synthetic polymers, metallized films, foils, laminates thereof and combinations thereof.

The term "holographic design" as used herein is to be understood to mean a three-dimensional image most visible from an oblique angle which is created by sophisticated techniques involving lasers and precise optical instruments. The unique properties of holographic designs are that they appear to float in space, are true-to-life and can change perspective, that is, permit one to look around corners and watch hidden features of the image come to light.

Further, the "holographic design" can be in any geometric form, or any combination of geometric forms, for example, squares, round spots, triangles, rectangles, octagonals, or the like (not shown); or any non-geometric, asymmetrical or fanciful forms, or any combination thereof, for example, but not by way of limitation, hearts, balloons, flowers, lace, slogans, logos, print (any combination of letters and/or numbers), signs, human forms (real and fictional) animal forms (real and fictional), cartoon characters, and/or plant forms. Such holographic designs may comprise a color, or a portion of a color, or any combination of colors. Alternatively, at least a portion of the holographic design may be colorless, translucent, transparent, opaque, pearlescent, iridescent, or the like.

In addition to the holographic design 70, the sheet of material 12*c* may have various colorings, coatings, embossings, printed material, flocking and/or metallic finishes, or other decorative surface ornamentation applied separately or simultaneously, both in registry or out of registry with one another and/or the holographic design 70 so that when the sheet of optical effect material 10*c* is cut into ribbon material, the ribbon material also is provided with an optical effect.

Shown in FIG. 6 is another embodiment of a sheet of laminated optical effect material 10*d* which comprises a first web or sheet of material 12*d* having a holographic design 70*d* and a second web or sheet of material 14*d*. The first sheet of material 12*d* has an upper surface 16*d*, a lower surface 18*d*, a first side 20*d* and a second side (not shown). The holographic design 70*d* is provided on the lower surface 18*d* of the first sheet of material 12*d*. However, it should be understood that the holographic design 70*d* can be provided on the upper surface 16*d*, or both the upper and lower surfaces 16*d* and 18*d* of the sheet of material 12*d*, and the holographic design 70*d* can be provided on only a portion of the sheet of material 12*d* or over the entire upper and/or lower surfaces 16*d* and 18*d* of the sheet of material 12*d*, depending on the appearance desired in ribbon material formed from the optical effect material 10*d*.

The first sheet of material 12*d*, in addition to the holographic design 70*d* on the lower surface 18*d* thereof, may have various colorings, coatings, embossings, printed materials, flocking and/or metallic finishes, or other decorative surface ornamentation applied separately or simultaneously, both in registry and out of registry with one another and/or the holographic design 70*d*, depending on the appearance desired in ribbon material formed from the optical effect material 10*d*.

The first sheet of material 12*d* of the optical effect material 10*d* has a thickness in a range of from about 0.1 mil to about 30 mil, preferably from about 0.1 mil to about 10 mil. The thickness of the sheet of material 12*d* should be selected so that the sheet of material 12*d* possesses sufficient flexibility to permit bows and other ornamental items to be formed from ribbon materials made from the sheet of laminated optical effect material 10*d*. The sheet of material 12*d* may be constructed of a number of materials having the required flexibility, such as paper, naturally occurring polymers such as cellophane, synthetic polymers, metallized films, foils, laminates thereof and combinations thereof.

The second sheet of material 14*d* has an upper surface 32*d*, a lower surface 34*d*, a first side 38*d* and a second side 40*d*. The second sheet of material 14*d* may be constructed of a flexible light transmitting material having a thickness in a range of from about 0.1 mil to about 30 mil, preferably from about 0.1 mil to about 10 mil, and more preferably from about 0.4 mil to about 0.9 mil; or the second sheet of material 14*d* may be constructed of paper, metallized films, foils, tinted or colored polymeric materials having a thickness in the range of from about 0.1 mil to about 30 mil, preferably from about 0.1 mil to 10 mil, and more preferably from about 0.4 mil to about 0.9 mil. The second sheet of material 14*d* is also provided with a bonding material 30*d* on the lower surface 34*d* thereof.

Examples of flexible light transmitting materials which can be used as the second sheet of material 14*d* are naturally occurring polymers, such as cellophane, synthetic polymers and combinations thereof. An example of a commercially available material which can be used as the second sheet of material 14*d* is Vifan BT medium slip biaxially oriented polypropylene film (clear), having a thickness in a range from between about 0.4 mil and about 0.9 mil, and which is available from Vifan Canada, Inc., Vifan street, Lanoraie d'Autray, Quebec, Canada JOK 1EO. Another example of a commercially available material which can be used as the second sheet of material 14*d* is HERCULES® B523 oriented polypropylene packaging film (clear), having a thickness in a range of between about 0.4 mil and about 0.9 mil, and which is available from Hercules Incorporated, Hercules Plaza, Wilmington, Del. 19894.

The second sheet of material 14*d* may also be a substantially flexible iridescent film having sufficient flexibility to permit ribbon materials produced from the sheet of laminated optical effect material 10*d* to be formed into bows and other decorative items. Generally, however, when the second sheet of material 14*d* is a flexible iridescent film, the second sheet of material 14*d* will preferably have a thickness in a range of from about 0.1 mil to about 10 mil, and more preferably from about 0.4 mil to about 0.9 mil. An example of a commercially available flexible iridescent film which can be used as the second sheet of material 14*d* of the optical effect material 10*d* is IF-8531 R/S, having a thickness in a range of from about 0.4 mil to about 0.9 mil, and which is manufactured by Mearl Corporation, 1050 Lower South Street, Peekskill, N.Y., 10566.

While the first and second sheets of material 12*d* and 14*d* have each been shown as being a single layer of material, it should be understood that the first sheet of material 12*d* may be constructed of a plurality of layers of the same or different types of materials which are laminated or bonded together and that the second sheet of material 14*d* may be constructed of a plurality of layers of the same or different types of materials which are laminated or bonded together.

The bonding material 30*d* used to laminate the first sheet of material 12*d* and the second sheet of material 14*d* to produce the sheet of laminated optical effect material 10*d* may be tinted or colored with a dye, pigment, or ink. In this manner, different coloring effects are provided, and the first sheet of material 12*d* and/or the second sheet of material 14*d* may be given a colored appearance by use of a colored bonding material as the bonding material 30*d*. Alternatively, or in addition to the tinting or coloring of the bonding material 30*d*, the first and/or second sheets of material 12*d* and 14*d* may also be tinted.

In operation, the second sheet of material 14*d* is placed adjacent the first sheet of material 12*d* so that the lower surface 34*d* of the second sheet of material 14*d* is disposed adjacent the upper surface 16*d* of the first sheet of material 12*d*. The bonding material 30*d* is disposed on the lower surface 34*d* of the second sheet of material 14*d* as shown. However, it should be understood that the bonding material 30*d* may be disposed on the upper surface 16*d* of the first sheet of material 12*d*, or upon the upper surface 16*d* of the first sheet of material 12*d* and the lower surface 34*d* of the second sheet of material 14*d*.

Embodiments of FIGS. 7–10

Figure 7:
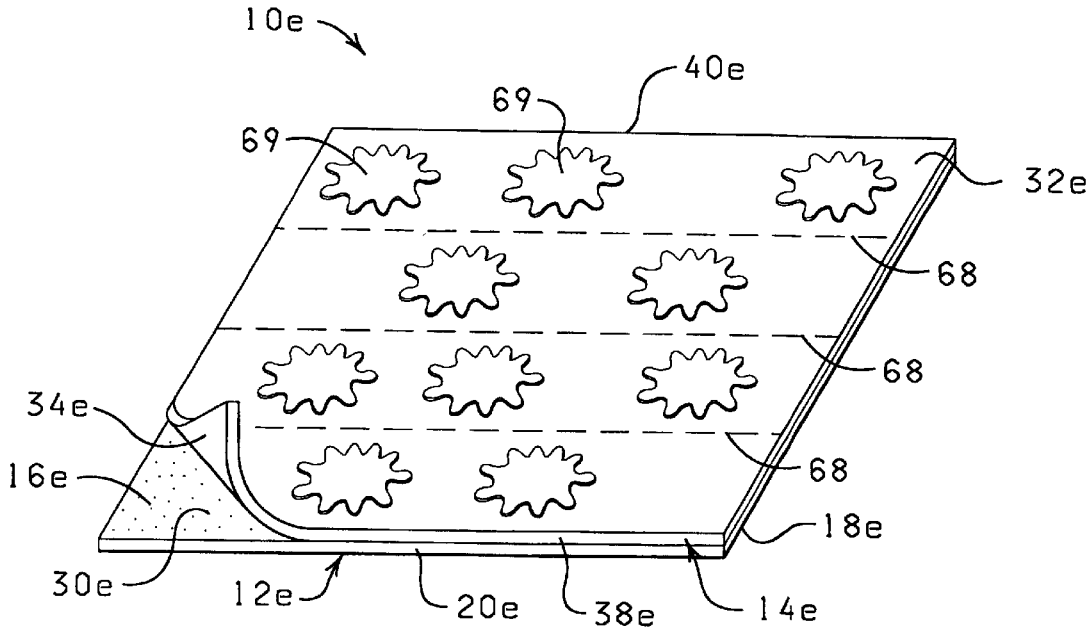
FIG. 7 is a perspective view of a web or sheet of a laminated optical effect material having an embossed pattern thereon.

Shown in FIG. 7 and designated therein by the general reference numeral 10*e* is a web or sheet of laminated optical effect material comprising a first web or sheet of material 12*e* and a second web or sheet of material 14*e*. The first sheet of material 12*e* has an upper surface 16*e*, a lower surface 18*e*, a first side 20*e* and a second side (not shown). A bonding material 30*e* may be disposed on the upper surface 16*e* of the first sheet of material 12*e* such that the bonding material 30*e* substantially covers the upper surface 16*e* of the first sheet of material 12*e*; or the bonding material 30*e* may also be disposed upon the upper surface 16*e* of the first sheet of material 12*e* in the form of one or more strips which extend between the first side 20*e* and the second side (not shown) of the first sheet of material 12*e*. It should be understood that the bonding material 30*e* may also be disposed upon the upper surface 16*e* of the first sheet of material 12*e* in the form of spaced apart spots; or the bonding material 30*e* may also be disposed on the upper surface 16*e* of the first sheet of material 12*e* in any other geometric or non-geometric or asymmetric forms, and in any pattern, including fanciful patterns.

The first sheet of material 12*e* is further characterized as a flexible material having a thickness in a range of from about 0.1 mil to about 30 mil, preferably from about 0.1 mil to about 10 mil, and more preferably from about 0.4 mil to about 0.9 mil. The thickness of the sheet of material 12*e* should be selected so that the sheet of material 12*e* possesses the desired flexibility to permit bows and other ornamental items to be formed from ribbon materials made from the optical effect material 10*e*. Desirably, the first sheet of material 12*e* is formed of a flexible material which is capable of transmitting light into the second sheet of material 14*e* and which permits the optical effect of the second sheet of material 14*e* to be substantially maintained when the second sheet of material 14*e* is viewed through the first sheet of material 12*e*. Examples of suitable flexible materials capable of transmitting light into the second sheet of material 14*e* which can be used to produce the first sheet of material 12*e* are naturally occurring polymers, such as cellophane, synthetic polymers and combinations thereof.

Flexible light transmitting polymeric materials which can be employed as the first sheet of material 12*e* are commercially available. An example of a commercially available material which can be used as the first sheet of material 12*e* is Vifan BT medium slip biaxially oriented polypropylene film (clear), having a thickness in a range from between about 0.4 mil and about 0.9 mil, and which is available from Vifan Canada, Inc., Vifan street, Lanoraie d'Autray, Quebec, Canada JOK 1EO. Another example of a commercially available material which can be used as the first sheet of material 12*e* is HERCULES® B523 oriented polypropylene packaging film (clear), having a thickness in a range of between about 0.4 mil and about 0.9 mil, and which is available from Hercules Incorporated, Hercules Plaza, Wilmington, Del. 19894.

While the first sheet of material 12*e* has been shown as being constructed of a single layer of flexible material capable of transmitting light into the second sheet of material 14*e*, it should be understood that the first sheet of material 12*e* may be constructed of paper, non-transparent polymer films, metallized film, cloth, burlap and the like. Further, the first sheet of material 12*e* may be constructed of a plurality of layers of the same or different types of materials which are laminated or bonded together, provided the flexibility properties of the first sheet of material 12*e* are maintained.

The second sheet of material 14*e* is a substantially flexible optical effect material, such as a flexible iridescent film as hereinbefore described with reference to FIGS. 1 through 4, or a flexible sheet of material having a holographic design as herein before described with reference to FIGS. 5 and 6. Thus, the second sheet of material 14*e* is characterized as having an upper surface 32*e*, a lower surface 34*e*, a first side 38*e* and a second side 40*e*. The second sheet of material 14*e* will generally have a thickness in a range of from about 0.1 mil to about 30 mil, preferably from about 0.1 mil to about 10 mil, and more preferably from about 0.4 mil to about 0.9 mil. Further, the second sheet of material 14*e* should be selected from a material having sufficient flexibility so that, when the first and second sheets of material 12*e* and 14*e* are bonded together, the optical effect material 10*e* so formed possesses sufficient flexibility to permit bows and other ornamental items to be formed from ribbon materials made from the sheet of optical effect material 10*e*.

When the second sheet of material 14*e* contains a holographic design, the second sheet of material 14*e* may be constructed of a number of materials having the required flexibility, such as paper, naturally occurring polymers, synthetic polymers, metallized films, foils, laminates thereof and combinations thereof. However, as previously stated, the second sheet of material 14*e* can also be a flexible iridescent film material. An example of a commercially available flexible iridescent film material which can be used as the second sheet of material 14*e* of the optical effect material 10*e* is IF-8531 R/S, having a thickness in a range of from about 0.4 mil to about 0.9 mil, and which is manufactured by Mearl Corporation, 1050 Lower south Street, Peekskill, N.Y., 10566.

In operation, the second sheet of material 14*e* is placed adjacent the first sheet of material 12*e* as shown in FIG. 7. In this position, the lower surface 34*e* of the second sheet of material 14*e* is disposed adjacent the upper surface 16*e* of the first sheet of material 12*e*. The first and second sheets of material 12*e* and 14*e* are then bonded together via the bonding material 30*e* disposed on the upper surface 16*e* of the first sheet of material 12*e*. It should be noted that while the bonding material 30*e* has been shown and described as being positioned on the upper surface 16*e* of the first sheet of material 12*e*, the bonding material 30*e* may be disposed on the lower surface 34*e* of the second sheet of material 14*e* or the bonding material 30*e* may be disposed on both the upper surface 16*e* of the first sheet of material 12*e* and the lower surface 34*e* of the second sheet of material 14*e*.

The dimensions of the first sheet of material 12*e* and the second sheet of material 14*e* are shown as being substantially equal so that when the first and the second sheets of material 12*e* and 14*e* are disposed adjacent each other, the first sheet of material 12*e* is substantially aligned with the second sheet of material 14*e*. As previously stated, however, it should be understood that it is not required that the first and second sheets of material 12*e* and 14*e* of the sheet of laminated optical effect material 10*e* have the same dimensions.

The sheet of laminated optical effect material 10*e* is further provided with an embossed pattern 69. The embossed pattern 69 may be produced by embossing the sheet of laminated optical effect material 10*e* using conventional embossing processes, or by embossing the first sheet of material 12*e* and/or the second sheet of material 14*e* prior to laminating the first and second sheets of material 12*e* and 14*e* to form the sheet of laminated optical effect material 10*e*. Further, the embossed pattern 69 may be aligned on the sheet of laminated optical effect material 10*e* in such a manner that the embossed pattern 69 uniformly lies within the boundaries of ribbon material (indicated by the dashed lines 68 in FIG. 7) produced from the sheet of laminated optical effect material 10*e*, or the embossed pattern 69 can be randomly positioned on the sheet of laminated optical effect material 10*e* so that the embossed pattern 69 is randomly positioned on the ribbon material produced from the sheet of optical effect material 10*e*.

Figure 8:
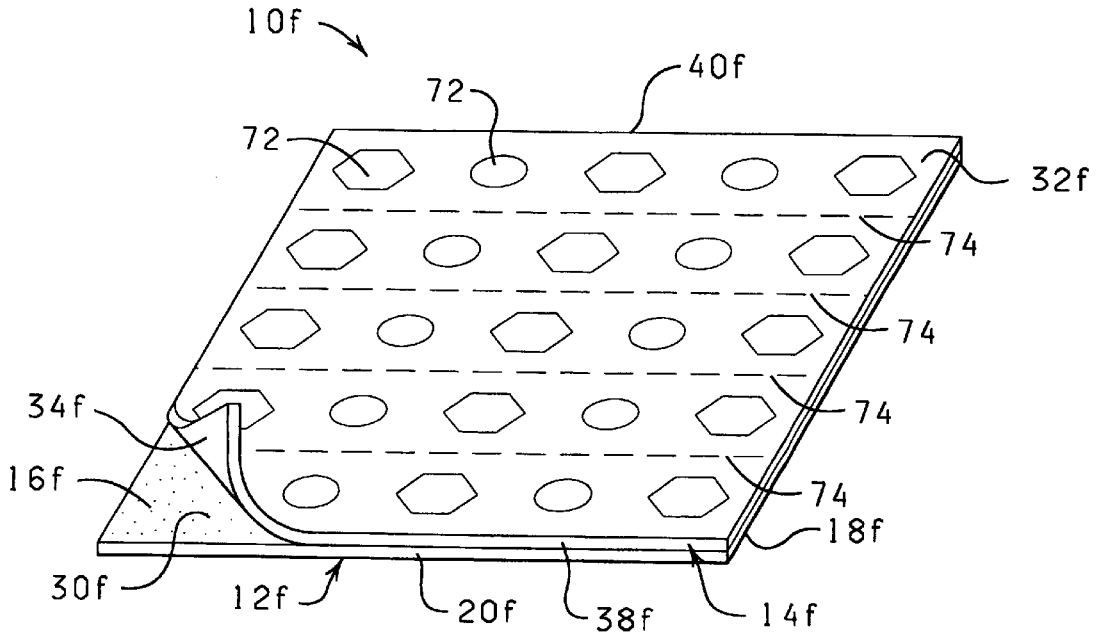
FIG. 8 is a perspective view of a web or sheet of a laminated optical effect material having a printed pattern thereon.

Shown in FIG. 8 and designated therein by the general reference numeral 10*f* is a web or sheet of laminated optical effect material comprising a first web or sheet of material 12*f* and a second web or sheet of material 14*f*. The first sheet of material 12*f* has an upper surface 16*f*, a lower surface 18*f*, a first side 20*f* and a second side (not shown). A bonding material 30*f* may be disposed on the upper surface 16*f* of the first sheet of material 12*f* such that the bonding material 30*f* substantially covers the upper surface 16*f* of the first sheet of material 12*f*; or the bonding material 30*f* may also be disposed upon the upper surface 16*f* of the first sheet of material 12*f* in the form of one or more strips which extend between the first side 20*f* and the second side (not shown) of the first sheet of material 12*f*. It should be understood that the bonding material 30*f* may also be disposed upon the upper surface 16*f* of the first sheet of material 12*f* in the form of spaced apart spots; or the bonding material 30*f* may also be disposed on the upper surface 16*f* of the first sheet of material 12*f* in any other geometric or non-geometric or asymmetric forms, and in any pattern, including fanciful patterns.

The first sheet of material 12*f* is a flexible material having a thickness in a range of from about 0.1 mil to about 30 mil, preferably from about 0.1 mil to about 10 mil, and more preferably from about 0.4 mil to about 0.9 mil. The thickness of the first sheet of material 12*f* should be selected so that the first sheet of material 12*f* possesses the desired flexibility to permit bows and other ornamental items to be formed from ribbon materials made from the sheet of laminated optical effect material 10*f*. Desirably, the first sheet of material 12*f* is formed of a flexible material which is capable of transmitting light into the second sheet of material 14*f* and permits the optical effect of the second sheet of material 14*f* to be substantially maintained when the second sheet of material 14*f* is viewed through the first sheet of material 12*f*. Examples of suitable flexible materials capable of transmitting light into the second sheet of material 14*f* which can be used to produce the first sheet of material 12*f* are naturally occurring polymers, synthetic polymers and combinations thereof.

Flexible light transmitting polymeric materials which can be employed as the first sheet of material 12*f* are commercially available. An example of a commercially available material which can be used as the first sheet of material 12*f* is Vifan BT medium slip biaxially oriented polypropylene film (clear), having a thickness in a range from between about 0.4 mil and about 0.9 mil, and which is available from Vifan Canada, Inc., Vifan street, Lanoraie d'Autray, Quebec, Canada JOK 1EO. Another example of a commercially available material which can be used as the first sheet of material 12*f* is HERCULES® B523 oriented polypropylene packaging film (clear), having a thickness in a range of between about 0.4 mil and about 0.9 mil, and which is available from Hercules Incorporated, Hercules Plaza, Wilmington, Del. 19894.

While the first sheet of material 12*f* has been shown as being constructed of a single layer of flexible material capable of transmitting light into the second sheet of material 14*f*, it should be understood that the first sheet of material 12*f* may be constructed of paper, non-transparent polymer film, metallized film, foil, cloth, burlap and the like. Further, the first sheet of material 12*f* may be constructed of a plurality of layers of the same or different types of materials which are laminated or bonded together, provided the flexibility properties of the first sheet of material 12*f* are maintained.

The second sheet of material 14*f* is a substantially flexible optical effect material, such as a flexible iridescent film as herein before described with reference to FIGS. 1 through 4, or a flexible sheet of material having a holographic design as herein before described with reference to FIGS. 5 and 6. Thus, the second sheet of material 14*f* is characterized as having an upper surface 32*f*, a lower surface 34*f*, a first side 38*f* and a second side 40*f*. The second sheet of material 14*f* will generally have a thickness in a range of from about 0.1 mil to about 30 mil, preferably from about 0.1 mil to about 10 mil, and more preferably from about 0.4 mil to about 0.9 mil. Further, the second sheet of material 14*f* should be selected from a material having sufficient flexibility so that, when the first and second sheets of material 12*f* and 14*f* are bonded together, the sheet of laminated optical effect material 10*f* so formed possesses sufficient flexibility to permit bows and other ornamental items to be formed from ribbon materials made from the sheet of laminated optical effect material 10*f*.

When the second sheet of material 14*f* contains a holographic design, the second sheet of material 14*f* may be constructed of a number of materials having the required flexibility, such as paper, naturally occurring polymers, synthetic polymers, metallized films, foils, laminates thereof and combinations thereof. However, as previously stated, the second sheet of material 14*f* can also be a flexible iridescent film material. An example of a commercially available flexible iridescent film material which can be used as the second sheet of material 14*f* of the sheet of laminated optical effect material 10*f* is manufactured by Mearl Corporation, 1050 Lower South Street, Peekskill, N.Y., 10566 and has a product reference number of IF-8531 R/S, and which has a thickness in a range of from about 0.4 mil to about 0.9 mil.

In operation, the second sheet of material 14*f* is placed adjacent the first sheet of material 12*f* as shown in FIG. 8. In this position, the lower surface 34*f* of the second sheet of material 14*f* is disposed adjacent the upper surface 16*f* of the first sheet of material 12*f*. The first and second sheets of material 12*f* and 14*f* are then bonded together via the bonding material 30*f* disposed on the upper surface 16*f* of the first sheet of material 12*f*. It should be noted that while the bonding material 30*f* has been shown and described as being positioned on the upper surface 16*f* of the first sheet of material 12*f*, the bonding material 30*f* may be disposed on the lower surface 34*f* of the second sheet of material 14*f* or the bonding material 30*f* may be disposed on both the upper surface 16*f* of the first sheet of material 12*f* and the lower surface 34*f* of the second sheet of material 14*f*.

The dimensions of the first sheet of material 12*f* and the second sheet of material 14*f* are shown as being substantially equal so that when the first and the second sheets of material 12*f* and 14*f* are disposed adjacent each other, the first sheet of material 12*f* is substantially aligned with the second sheet of material 14*f*. As previously stated, however, it should be understood that it is not required that the laminated sheets of material, such as the first and second sheets of material 12*f* and 14*f* of the sheet of laminated optical effect material 10*f* have the same dimensions.

The sheet of laminated optical effect material 10*f* is further provided with a printed pattern or printed material 72. The printed pattern 72 may be produced by printing the sheet of laminated optical effect material 10*f* using conventional printing processes, or by printing the first of material 12*f* and/or the second sheet of material 14*f* prior to laminating the first and second sheets of material 12*f* and 14*f* to form the sheet of laminated optical effect material 10*f*. Further, the printed pattern 72 may be aligned on the sheet of laminated optical effect material 10*f* in such a manner that the printed pattern 72 uniformly lies within the boundaries of ribbon material (indicated by the dashed line 74 in FIG. 8) produced from the sheet of laminated optical effect material 10*f*, or the printed pattern 72 can be randomly positioned on the sheet of laminated optical effect material 10*f* so that the printed pattern 72 is randomly positioned on the ribbon material produced from the sheet of laminated optical effect material 10*f*.

Figure 9:
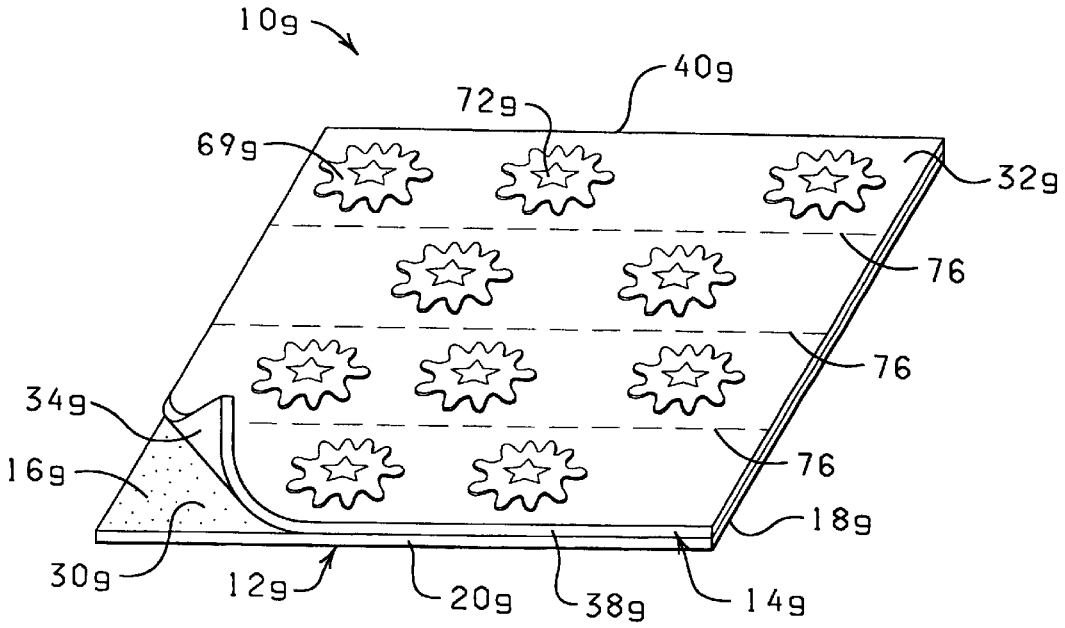
FIG. 9 is a perspective view of a web or sheet of optical effect material having an embossed pattern and a printed pattern wherein the embossed and printed patterns are in registry with one another.
Figure 10:
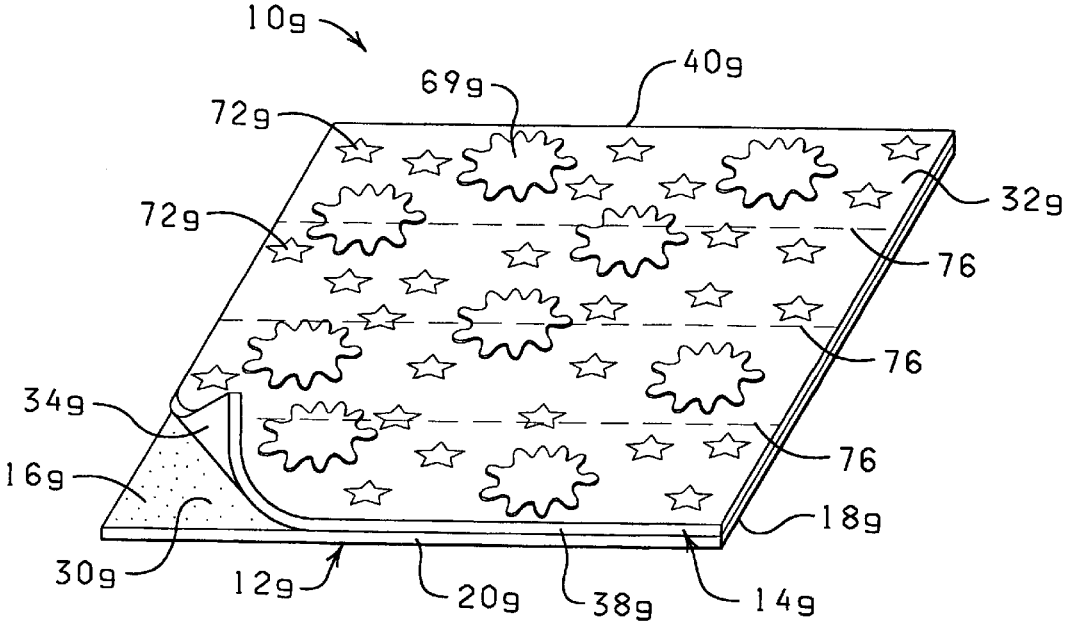
FIG. 10 is a perspective view of a web or sheet of a laminated optical effect material having an embossed pattern and a printed pattern wherein the embossed and printed patterns are out of registry with one another.

Referring now to FIGS. 9 and 10, a web or sheet of laminated optical effect material 10*g* comprising a first web or sheet of material 12*g* and a second web or sheet of material 14*g* is illustrated. The first sheet of material 12*g* has an upper surface 16*g*, a lower surface 18*g*, a first side 20*g* and a second side (not shown). A bonding material 30*g* may be disposed on the upper surface 16*g* of the first sheet of material 12*g* such that the bonding material 30*g* substantially covers the upper surface 16*g* of the first sheet of material 12*g*; or the bonding material 30*g* may be disposed upon the upper surface 16*g* of the first sheet of material 12*g* in the form of one or more strips which extend between the first side 18*g* and the second side (not shown) of the first sheet of material 12*g*. It should be understood that the bonding material 30*g* may be disposed upon the upper surface 16*g* of the first sheet of material 12*g* in the form of spaced apart spots; or the bonding material 30*g* may be disposed on the upper surface 16*g* of the first sheet of material 12*g* in any other geometric or non-geometric or asymmetric forms, and in any pattern, including fanciful patterns.

The first sheet of material 12*g* is further characterized as a flexible material having a thickness in a range of from about 0.1 mil to about 30 mil, preferably from about 0.1 mil to about 10 mil, and more preferably from about 0.4 mil to about 0.9 mil. The thickness of the sheet of material 12*g* should be selected so that the sheet of material 12*g* possesses the desired flexibility to permit bows and other ornamental items to be formed from ribbon materials made from the sheet of laminated optical effect material 10*g*. Desirably, the first sheet of material 12*g* is formed of a flexible material which is capable of transmitting light into the second sheet of material 14*g* and which permits the optical effect of the second sheet of material 14*g* to be substantially maintained when the second sheet of material 14*g* is viewed through the first sheet of material 12*g*. Examples of suitable flexible materials capable of transmitting light into the second sheet of material 14*g* which can be used to produce the first sheet of material 12*g* are naturally occurring polymers, synthetic polymers and combinations thereof.

Flexible light transmitting polymeric materials which can be employed as the first sheet of material 12*g* are commercially available. An example of a commercially available material which can be used as the first sheet of material 12*g* is Vifan BT medium slip biaxially oriented polypropylene film (clear), having a thickness in a range from between about 0.4 mil and about 0.9 mil, and which is available from Vifan Canada, Inc., Vifan street, Lanoraie d'Autray, Quebec, Canada JOK 1EO. Another example of a commercially available material which can be used as the first sheet of material 12*g* is HERCULES® B523 oriented polypropylene packaging film (clear), having a thickness in a range of between about 0.4 mil and about 0.9 mil and which is available from Hercules Incorporated, Hercules Plaza, Wilmington, Del. 19894.

While the first sheet of material 12*g* has been shown as being constructed of a single layer of flexible material capable of transmitting light into the second sheet of material 14*g*, it should be understood that the first sheet of material 12*g* may be constructed of paper, non-transparent polymeric film, metallized film, foil, cloth, burlap and the like. Further, the first sheet of material 12*g* may be constructed of a plurality of layers of the same or different types of materials which are laminated or bonded together, provided the flexibility properties of the first sheet of material 12*g* are maintained.

The second sheet of material 14*g* is a substantially flexible optical effect material, such as a flexible iridescent film as hereinbefore described with reference to FIGS. 1 to 4, or a flexible sheet of material having a holographic design as herein-before described with reference to FIGS. 5 and 6. Thus, the second sheet of material 14*g* is characterized as having an upper surface 32*g*, a lower surface 34*g*, a first side 38*g* and a second side 40*g*. The second sheet of material 14*g* will generally have a thickness in a range of from about 0.1 mil to about 30 mil, preferably from about 0.1 mil to about 10 mil, and more preferably from about 0.4 mil to about 0.9 mil. Further, the second sheet of material 14*g* should be selected from a material having sufficient flexibility so that when the first and second sheets of material 12*g* and 14*g* are bonded together the sheet of laminated optical effect material 10*g* so formed possesses sufficient flexibility to permit bows and other ornamental items to be formed from ribbon materials made from the sheet of laminated optical effect material 10*g*.

When the second sheet of material 14*g* contains a holographic design, the sheet of material 14*g* may be constructed of a number of materials having the required flexibility, such as paper, naturally occurring polymers, synthetic polymers, metallized films, foils, laminates thereof and combinations thereof. However, as previously stated, the second sheet of material 14*g* can also be a flexible iridescent film material. An example of a commercially available flexible iridescent film material which can be used as the second sheet of material 14*g* of the sheet of laminated optical effect material 10*g* is IF-8531 R/S, having a thickness in a range of from about 0.4 mil to about 0.9 mil, and which is manufactured by Mearl Corporation, 1050 Lower South Street, Peekskill, N.Y., 10566.

The sheet of laminated optical effect material 10*g* is further provided with an embossed pattern 69*g*. The embossed pattern 69*g* may be produced by embossing the sheet of laminated optical effect material 10*g* using conventional embossing processes, or by embossing the first sheet of material 12*g* and/or the second sheet of material 14*g* prior to laminating the first and second sheets of material 12*g* and 14*g* to form the sheet of laminated optical effect material 10*g*. Further, the embossed pattern 69*g* may be aligned on the sheet of laminated optical effect material 10*g* in such a manner that the embossed pattern 69*g* uniformly lies within the boundaries of ribbon material (indicated by the dashed lines 76 in FIG. 9) produced from the sheet of laminated optical effect material 10*g*, or the embossed pattern 69*g* can be randomly positioned on the sheet of laminated optical effect material 10*g* so that the embossed pattern 69*g* is randomly positioned on the ribbon material produced from the sheet of laminated optical effect material log (FIG. 10).

The sheet of optical effect material 10*g* is further provided with a printed pattern or printed material 72*g*. The printed pattern 72*g* may be produced by printing the sheet of laminated optical effect material 10*g* using conventional printing processes prior to or subsequent to embossing the sheet of laminated optical effect material 10*g*, or by printing the first sheet of material 12*g* and/or the second sheet of material 14*g* prior to embossing and laminating the first and/or second sheets of material 12*g* and 14*g* to form the sheet of laminated optical effect material dog. The printed pattern 72*g* may be in register with the embossed pattern 69*g* or at least a portion thereof as shown in FIG. 9, or the printed pattern 72*g* may be randomly positioned relative to the embossed pattern 69*g* so that the printed pattern 72*g* and the embossed pattern 69*g* are out of register as shown in FIG. 10. The term "in register" as used herein is to be understood to mean that the embossed pattern 69*g* and the printed pattern 72*g* are positioned on the sheet of laminated optical effect material 10*g* in predetermined positions so that the embossed pattern 69*g* and the printed pattern 72*g* are disposed within the confines of a unitary pattern.

The term "out of register" as used herein is to be understood to mean that the printed pattern 72*g* is arbitrarily positioned with respect to the embossed pattern 69*g*.

In addition, the embossed pattern 69*g* and the printed pattern 72*g*, whether in or out of register, can be aligned on the sheet of laminated optical effect material log in such a manner that the embossed pattern 69*g* and the printed pattern 72*g* uniformly lie within the boundaries of ribbon material (as indicated by the dashed line 76 in FIG. 9) produced from the sheet of laminated optical effect material 10*g*; or the embossed pattern 69*g* and the printed pattern 72*g*, whether in or out of register, can be randomly positioned on the sheet of laminated optical effect material 10*g* so that the embossed pattern 69*g* and the printed pattern 72*g* are randomly positioned on the ribbon material produced from the sheet of laminated optical effect material 10*g* and do not lie within the boundaries of ribbon material (as indicated by the dashed line 76 in FIG. 10) produced from the sheet of laminated optical effect material 10*g*.

The printed pattern 72*g* may be applied to at least one surface of the first and/or second sheets of material 12*g* and 14*g* by conventional printing techniques. In addition, the first and/or second sheets of material 12*g* and 14*g* may have various colorings, coatings, flocking and/or metallic finishes, or other decorative surface ornamentation applied separately or simultaneously or may be characterized totally or partially by pearlescent, translucent, transparent, iridescent or the like qualities. Each of the above-named characteristics may occur alone or in combination and may be applied to the upper and/or lower surfaces 16 and 18 and/or 32 and 34 of the first and/or second sheets of material 12*g* and 14*g*, respectively. Moreover, each surface of the first and/or second sheets of material 12*g* and 14*g* may vary in the combination of such characteristics.

Figure 11:
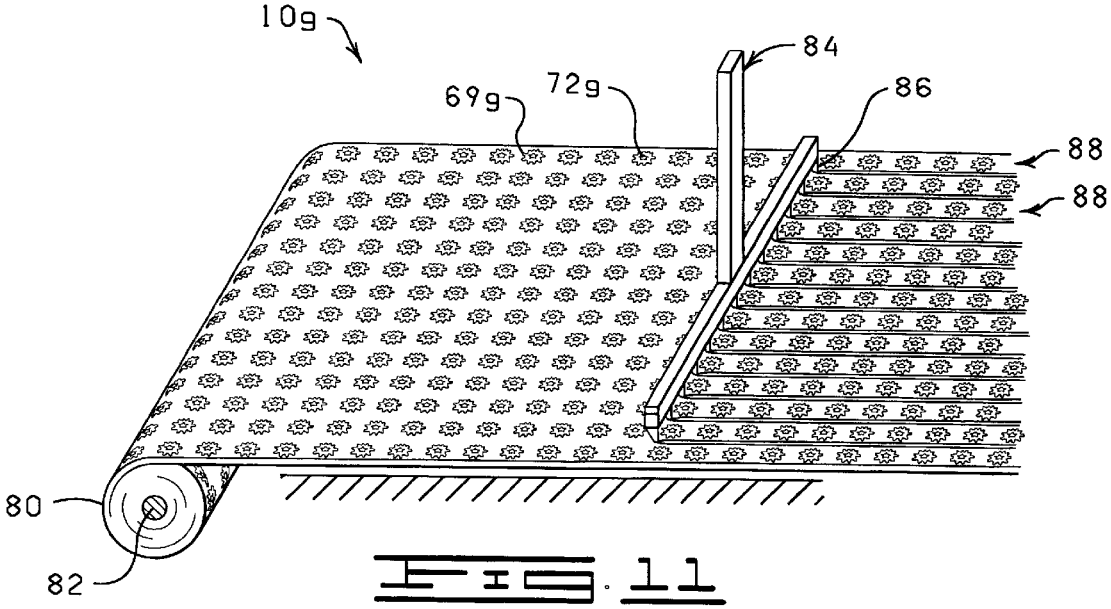
FIG. 11 is a perspective view of a roll of optical effect material illustrating a knife edge being actuated by an actuator to cut the roll of optical effect material into ribbon material.

Embodiment of FIG. 11

Shown in FIG. 11 is a roll 80 of an optical effect material, such as the optical effect material 10*g* wherein the printed pattern 72*g* is in register with the embossed pattern 69*g* as shown in FIG. 9. It is to be understood that the roll 80 could contain any of the optical effect materials hereinbefore described. The roll 80 of the optical effect material 10*g* is supported on a mounted shaft 82. The optical effect material 10*g* is withdrawn from the roll 80 of optical effect material 10*g* and passed through a knife assembly 84 having a plurality of cutting elements 86 whereby the optical effect material 10*g* is cut into ribbon material 88 of a uniform, predetermined width. The ribbon material 88 so produced can then be wound via take up rollers to produce spools of the ribbon material 88 in a conventional manner. It should also be understood that one could produce the optical effect material 10*g* so that the optical effect material 10*g* has a width which corresponds to the desired width of the ribbon material 88. In such event, the cutting of the optical effect material 10*g* to produce the ribbon material 88 can be eliminated. The production of ribbon material from webs or sheets of material is well known. Thus, no further description of the production of the ribbon material 88 from the optical effect material 10*g* is believed necessary.

Figure 12:
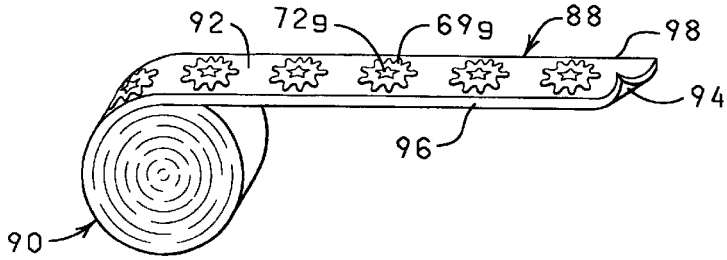
FIG. 12 is a perspective view of a roll of ribbon material having an optical effect design or pattern provided on at least one surface thereof.
Figure 13:
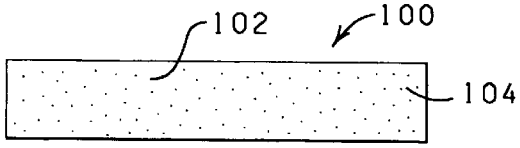
FIG. 13 is a plan view of a lower surface of a segment of ribbon material wherein the ribbon material is provided with a bonding material on a lower surface thereof.
Figure 14:
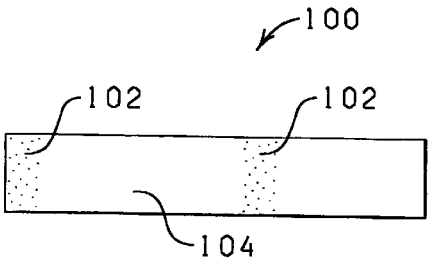
FIG. 14 is a plan view of a lower surface of a segment of ribbon material wherein the ribbon material is provided with strips of spatially disposed bonding material on a lower surface thereof.

Embodiments of FIGS. 12–14

Shown in FIG. 12 and designated therein by the general reference numeral 90 is a roll or spool of ribbon material produced from the optical effect materials hereinbefore described, such as the ribbon material 88. Thus, the ribbon material 88 possesses the same optical effect properties as the optical effect material 10*g* from which it is produced. The ribbon material 88 has an upper surface 92, a lower surface 94, a first side 96 and a second side 98. The printed pattern 72*g* is in register with the embossed pattern 69*g* and the resulting unitary design lies within the boundaries of the ribbon material 88, i.e. the unitary design is positioned between the first side 96 and the second side 98 of the ribbon material 88 substantially as shown.

Shown in FIGS. 13 and 14 is a segment of a modified ribbon material 100 produced from the optical effect materials hereinbefore described and which possesses the same optical effect properties as the optical effect material from which it is produced. To enhance retention of a bow or ornate configuration formed with the ribbon material 100, the ribbon material 100 is provided with a bonding material 102 can be provided on a lower surface 104 of the ribbon material 100 (FIG. 13); or spatially disposed strips of the bonding material 102 can be provided on the lower surface 104 of the ribbon material 100 (FIG. 14). While the bonding material 102 has been shown as being spatially disposed strips in FIG. 14, it should be understood that the bonding material 102 can be applied to the lower surface 104 of the ribbon material 100 in any other geometric or non-geometric or asymmetric forms, and in any pattern.

The bonding material 102 can be any suitable adhesive or cohesive material capable of retaining the ribbon material 100 in a desired bow or ornate configuration. However, when using an adhesive material, a release strip or paper (not shown) is used to prevent undesired bonding of the ribbon material 100. On the other hand, if the bonding material is a cohesive material, such material will only create a bond when brought into contact with another area of the ribbon material 100 having a cohesive material thereon.

Embodiments of FIGS. 15–18

FIGS. 15–18 depict representative decorative bows which can be made from the ribbon material produced from the optical effect material hereinbefore described. The term "decorative bow" as used herein is to be understood to mean an ornamental structure formed from the ribbon materials hereinbefore described. The decorative bow may be provided with gathered portions, ruffles, loops, curved segments and the like.

Figure 15:
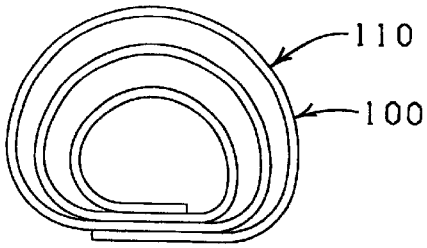
FIG. 15 is a ribbon configuration or bow produced from the ribbon material constructed in accordance with the present invention.

Shown in FIG. 15 and designated therein by the general reference numeral 110 is a spiral-shape decorative bow formed from a ribbon material, such as the ribbon material 100 shown in FIG. 13.

Figure 16:
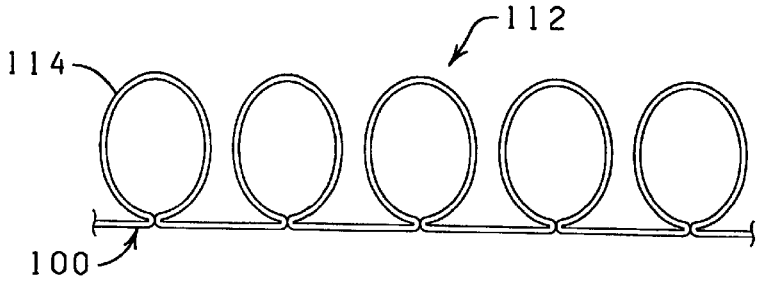
FIG. 16 is another embodiment of a ribbon configuration or bow produced from the ribbon material constructed in accordance with the present invention.

Shown in FIG. 16 and designated therein by the reference numeral 112 is decorative bow formed from the ribbon material 100 wherein the bow 112 is provided with a plurality of spatially disposed loops 114.

Figure 17:
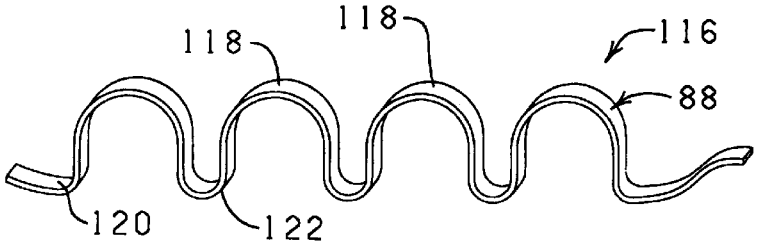
FIG. 17 is another embodiment of a ribbon configuration or bow produced from the ribbon material constructed in accordance with the present invention.

Shown in FIG. 17 and designated therein by the reference numeral 116 is a decorative bow formed from ribbon material, such as the ribbon material 88, wherein the bow 116 is provided with curved segments 118 in which the ends 120 and 122 of the curved segments 118 are spaced apart so as to provide the bow 116 with a ruffled appearance.

Figure 18:
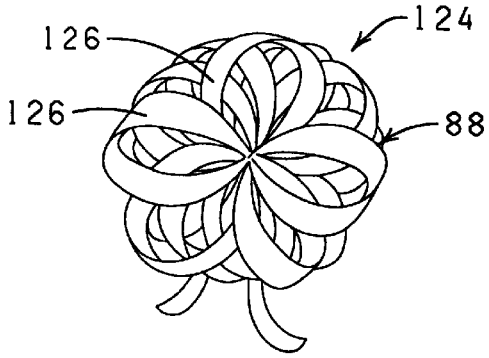
FIG. 18 is yet another embodiment of a ribbon configuration or bow produced from the ribbon material constructed in accordance with the present invention.

Shown in FIG. 18 and designated therein by the reference numeral 124 is a decorative bow formed from the ribbon material 88. The decorative bow 124, which is sometimes referred to in the decorative arts as a "pom" bow, is provided with a plurality of curved segments which form loops 126. The loops 126 cooperate to provide the decorative bow 124 with a pom-pom-like configuration.

It should be understood that the decorative bows depicted in FIGS. 15–18 only represent a small number of decorative bows which can be produced from the ribbon material disclosed herein.

Further, changes may be made in the construction and the operation of the various components, elements and assemblies described herein or in the steps or the sequence of steps of the methods described herein without departing from the spirit and scope of the invention as defined in the following claims.

What is claimed:

1. A ribbon material for wrapping about items and forming into bows and decorative ornamentations containing ruffles, loops and curved segments, the ribbon material produced by cutting a sheet or web of material into strips having a uniform width and which are capable of being wound onto a spool or roll, the ribbon material having boundaries and comprising:

a flexible material having an upper surface, a lower surface, and a holographic design on at least a portion of one of the upper and lower surfaces thereof, wherein the flexible material is formed of a material selected from the group consisting of paper, polymeric film, metallized film, foil, laminates thereof and combinations thereof, and wherein the flexible material has a thickness in the range of from about 0.1 mil to about 30 mil.

2. The ribbon material of claim 1 wherein the flexible material is provided with a printed pattern disposed on at least a portion of one of the upper and lower surfaces thereof such that the ribbon material further comprises an embossed pattern.

3. The ribbon material of claim 2 wherein the flexible material is provided with an embossed pattern disposed on at least a portion of one of the upper and lower surfaces thereof such that the ribbon material further comprises an embossed pattern.

4. The ribbon material of claim 3 wherein at least a portion of the printed pattern and the embossed pattern are in register with one another and lie within the boundaries of the ribbon material.

5. The ribbon material of claim 3 wherein at least a portion of the printed pattern and the embossed pattern are in register with one another.

6. The ribbon material of claim 3 wherein at least a portion of the printed pattern and the embossed pattern are out of register with one another.

7. The ribbon material of claim 3 wherein at least a portion of the printed pattern and the embossed pattern are out of register with one another and wherein the printed pattern and the embossed pattern lie within the boundaries of the ribbon material.

8. The ribbon material of claim 1 wherein the flexible material is provided with an embossed pattern disposed on at least a portion of one of the upper and lower surfaces thereof such that the ribbon material further comprises an embossed pattern.

9. The ribbon material of claim 8 wherein the embossed pattern lies within the boundaries of the ribbon material.

10. A laminated ribbon material for wrapping about items and forming into bows and decorative ornamentations containing ruffles, loops and curved segments, the laminated ribbon material produced by cutting a flexible sheet or web of laminated material into strips having a uniform width and which are capable of being wound onto a spool or roll, the laminated ribbon material having boundaries and comprising:

a flexible iridescent material having an upper surface and a lower surface, the flexible iridescent material having a thickness in the range of from about 0.1 mil to about 10 mil; and a flexible material laminated to one of the upper and lower surfaces of the flexible iridescent material so that iridescent qualities of the flexible iridescent material remain visible when the laminated ribbon material is wrapped about items and formed into bows and decorative ornamentations, the flexible material having a thickness in the range of from about 0.1 mil to about 30 mil.

11. The laminated ribbon material of claim 10 wherein the flexible material laminated to one of the upper and lower surfaces of the flexible iridescent material is a material selected from the group consisting of paper, polymeric film, metallized film, foil, cloth, burlap, laminates thereof and combinations thereof.

12. The laminated ribbon material of claim 10 wherein the flexible iridescent material and the flexible material are laminated with a tinted or colored bonding material.

13. The laminated ribbon material of claim 10 wherein at least a portion of one surface of one of the flexible material, the flexible iridescent material, the sheet or web of laminated material or the laminated ribbon material is provided with an embossed pattern disposed thereon.

14. The laminated ribbon material of claim 10 wherein at least a portion of one surface of one of the flexible material, the flexible iridescent material, the sheet or web of laminated material or the laminated ribbon material is provided with an embossed pattern and a printed pattern disposed thereon.

15. The laminated ribbon material of claim 14 wherein the printed pattern is in registry with the embossed pattern and wherein the embossed and printed patterns lie within the boundaries of the laminated ribbon material.

16. The laminated ribbon material of claim 14 wherein the printed pattern is out of registry with the embossed pattern.

17. The laminated ribbon material of claim 16 wherein the embossed pattern and the printed pattern lie within the boundaries of the laminated ribbon material.

18. The laminated ribbon material of claim 10 wherein at least a portion of one surface of one of the flexible material, the flexible iridescent material, the sheet or web of laminated material or the laminated ribbon material is provided with a printed pattern disposed thereon.

19. The laminated ribbon material of claim 18 wherein the printed pattern lies within the boundaries of the laminated ribbon material.

20. The laminated ribbon material of claim 10 wherein the flexible material is provided with an upper surface and a lower surface and wherein at least one of the upper and lower surfaces of the flexible material is provided with a matte or textured finish simulating the appearance of cloth such that at least a portion of the laminated ribbon material formed therefrom is provided with a finish simulating the appearance of cloth.

21. The laminated ribbon material of claim 10 wherein the flexible iridescent material has a thickness in the range of from about 0.4 mil to about 0.9 mil and wherein the flexible material has a thickness in the range of from about 0.4 mil to about 0.9 mil.

22. A laminated ribbon material for wrapping about items and forming into bows and decorative ornamentations containing ruffles, loops and curved segments, the laminated ribbon material produced by cutting a flexible sheet or web of laminated material into strips having a uniform width and which are capable of being wound onto a spool or roll, the laminated ribbon material having boundaries comprising:

a flexible first material having an upper surface, a lower surface and a holographic design on at least a portion of one of the upper and lower surfaces thereof, wherein the flexible first material is formed of a material selected from the group consisting of paper, polymeric film, metallized film, foil, laminates thereof and combinations thereof, the flexible first material having a thickness in the range of from about 0.1 mil to about 30 mil; and a flexible second material laminated to one of the upper and lower surfaces of the flexible first material so that the holographic design of the flexible first material remains visible when the ribbon material is wrapped about items and formed into bows and decorative ornamentations, wherein the flexible second material is formed of a material selected from the group consisting of paper, polymeric film, metallized film, foil, cloth, burlap, laminates thereof and combinations thereof, the flexible material having a thickness in the range of from about 0.1 mil to about 30 mil.

23. The laminated ribbon material of claim 22 wherein the flexible first material having a holographic design and the flexible second material each have a thickness in the range of from about 0.1 mil to about 10 mil.

24. The laminated ribbon material of claim 22 wherein the flexible first material having a holographic design and the flexible second material each have a thickness in the range of from about 0.4 mil to about 0.9 mil.

25. The laminated ribbon material of claim 22 wherein the flexible first material having a holographic design and the flexible second material are laminated with a tinted or colored bonding material.

26. The laminated ribbon material of claim 22 wherein at least a portion of one surface of one of the flexible first material having a holographic design, the flexible second material, the flexible sheet or web of laminated material or the laminated ribbon material is provided with an embossed pattern disposed thereon.

27. The laminated ribbon material of claim 22 wherein at least a portion of one surface of one of the flexible first material, the flexible second material, the flexible sheet or web of laminated material or the laminated ribbon material is provided with an embossed pattern and a printed pattern disposed thereon.

28. The laminated ribbon material of claim 27 wherein the printed pattern is in registry with the embossed pattern and wherein the holographic design, the embossed pattern and the printed pattern lie within the boundaries of the laminated ribbon material.

29. The laminated ribbon material of claim 27 wherein the printed pattern is out of registry with the embossed pattern and wherein the holographic design, the embossed pattern and the printed pattern lie within the boundaries of the laminated ribbon material.

30. The laminated ribbon material of claim 22 wherein at least a portion of one surface of one of the flexible first material having a holographic design, the flexible second material, the flexible sheet or web of laminated material or the laminated ribbon material is provided with a printed pattern disposed thereon.

31. The laminated ribbon material of claim 30 wherein the printed pattern lies within the boundaries of the laminated ribbon material.

32. The laminated ribbon material of claim 22 wherein the flexible second material is provided with an upper surface and a lower surface, and wherein at least a portion of one of the upper and lower surfaces of the flexible first material having a holographic design or at least a portion of one of the upper and lower surfaces of the flexible second material is provided with a matte or textured finish simulating the appearance of cloth such that at least a portion of one surface of the laminated ribbon material formed therefrom is provided with a matte or textured finish simulating the appearance of cloth.

33. A ribbon material for wrapping about items and forming into bows and decorative ornamentations containing ruffles, loops and curved segments, the ribbon material produced by cutting a sheet or web of flexible material into strips having a uniform width and which are capable of being wound onto a spool or roll, the ribbon material having boundaries and comprising:

a flexible material having an upper surface, a lower surface and a holographic design on at least a portion of one of the upper and lower surfaces thereof, wherein the flexible material is formed of a material selected from the group consisting of paper, polymeric film, metallized film, foil, laminates thereof and combinations thereof, the flexible material having a thickness in the range of from about 0.1 mil to about 30 mil, and wherein the flexible material is provided with a printed pattern on at least a portion of one of the upper and lower surfaces thereof and an embossed pattern on at least a portion of one of the upper and lower surfaces thereof such that the ribbon material formed therefrom has printed and embossed patterns thereon.

34. The ribbon material of claim 33 wherein at least a portion of the printed pattern is in register with the embossed pattern.

35. The ribbon material of claim 34 wherein the printed and embossed patterns lie within the boundaries of the ribbon material.

36. The ribbon material of claim 33 wherein at least a portion of the printed pattern is out of register with the embossed pattern.

37. The ribbon material of claim 36 wherein the printed and embossed patterns lie within the boundaries of the ribbon material.

38. The laminated ribbon material of claim 10 wherein the flexible material laminated to the flexible iridescent material is transparent such that the iridescent qualities of the flexible iridescent material are visible through the flexible material laminated thereto.

39. The laminated ribbon material of claim 22 wherein the flexible second material is transparent and laminated to the surface of the flexible first material having the holographic design disposed thereon such that the holographic design of the flexible first material is visible through the flexible second material.

* * * * *

UNITED STATES PATENT AND TRADEMARK OFFICE

CERTIFICATE OF CORRECTION

PATENT NO. : 6,387,459 B1
DATED : May 14, 2002
INVENTOR(S) : Donald E. Weder

It is certified that error appears in the above-identified patent and that said Letters Patent is hereby corrected as shown below:

Title page,
Item [63], Related U.S. Application Data, after the word "abandon" and beginning with the word "which" delete the remainder of the paragraph.

Signed and Sealed this

Twenty-third Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,387,459 B1
DATED : May 14, 2002
INVENTOR(S) : Donald E. Weder

It is certified that error appears in the above-identified patent and that said Letters Patent is hereby corrected as shown below:

Title page,
Item [63], Related U.S. Application Data, after the word "abandoned" "which is a continuation-in-part of application No. 08/717,336, filed on Sep. 20, 1996, now Pat. No. 5,921,061, which is a continuation-in-part of application No. 08/454,474, filed on May 30, 1995, now Pat. No. 5,701,720, which is a continuation of application No. 08/179,057, filed on Jan. 7, 1994, now Pat. No. 5,576,089.(as deleted by Certificate of Correction issued March 23, 2004) should be reinstated.
Item [56], References Cited, U.S. PATENT DOCUMENTS, add:
-- 5,624,320 A 4/1997 Martinez 472/51 --

Column 2,
Line 55, delete the "hyphen(-)" in word "contemplated".

Column 9,
Line 64, after number "12c" and before the word "upper" add words -- has an --.

Column 18,
Lines 29 and 56, change the word "log" to number 10g --.
Line 39, change the word "dog" to number -- 10g --.

Signed and Sealed this

Third Day of August, 2004

JON W. DUDAS
*Acting Director of the United States Patent and Trademark Office*